US011648437B1

(12) United States Patent
Cifuentes et al.

(10) Patent No.: US 11,648,437 B1
(45) Date of Patent: May 16, 2023

(54) FITNESS BLOCK

(71) Applicants: Wilber Rene Cifuentes, West Hills, CA (US); Arely Cifuentes, West Hills, CA (US)

(72) Inventors: Wilber Rene Cifuentes, West Hills, CA (US); Arely Cifuentes, West Hills, CA (US)

( * ) Notice: Subject to any disclaimer, the term of this patent is extended or adjusted under 35 U.S.C. 154(b) by 0 days.

(21) Appl. No.: 17/940,680

(22) Filed: Sep. 8, 2022

Related U.S. Application Data

(60) Provisional application No. 63/300,844, filed on Jan. 19, 2022.

(51) Int. Cl.
*A63B 21/00* (2006.01)
*A63B 23/04* (2006.01)

(52) U.S. Cl.
CPC ..... *A63B 21/4033* (2015.10); *A63B 23/0458* (2013.01)

(58) Field of Classification Search
CPC ..... A63B 21/0004; A63B 21/00061; A63B 21/00065; A63B 21/0552; A63B 21/065; A63B 21/072; A63B 21/4033; A63B 21/4035; A63B 21/4039; A63B 23/03525; A63B 23/03541; A63B 23/03508; A63B 23/1209; A63B 23/0405; A63B 23/0458; A63B 23/047
See application file for complete search history.

(56) References Cited

U.S. PATENT DOCUMENTS

| | | | | |
|---|---|---|---|---|
| 5,651,753 | A * | 7/1997 | Wilkinson | A63B 23/0458 482/52 |
| 6,123,651 | A * | 9/2000 | Ellenburg | A63B 71/0036 482/104 |
| 7,922,624 | B1 * | 4/2011 | Fairhurst | A63B 21/0552 482/52 |
| 8,702,570 | B1 | 4/2014 | DelPriore | |
| 9,925,408 | B1 * | 3/2018 | Murdock | A63B 21/4043 |
| 10,188,892 | B1 * | 1/2019 | Gvoich | A63B 21/4035 |
| 10,315,064 | B2 * | 6/2019 | Pinkus | A63B 23/03541 |
| 10,898,754 | B2 * | 1/2021 | Sandhu | A63B 21/063 |
| 11,072,464 | B2 * | 7/2021 | Freedman | A63B 21/0557 |

(Continued)

OTHER PUBLICATIONS

Hausmann, Weight Box, Retrieved from Internet, Retrieved on Dec. 21, 2021 <URL: https://www.hausmann.com/product/carry-all-weight-box/>.

(Continued)

*Primary Examiner* — Andrew S Lo
*Assistant Examiner* — Zachary T Moore

(57) ABSTRACT

A multipurpose fitness block suitable for a variety of upper body and lower body exercises is presented. The multipurpose fitness block contains a block body, a plurality of weight inserts, a carrying handle, and a plurality of attachment elements. The block body contains a plurality of handling channels and a plurality of weight holders. The plurality of weight holders is distributed about the block body. The plurality of handling channels is distributed about the block body. The plurality of weight inserts is connected along the plurality of weight holders. The carrying handle is connected adjacent to the block body. The plurality of attachment elements is distributed about the block body.

14 Claims, 7 Drawing Sheets

(56) References Cited

U.S. PATENT DOCUMENTS

| | | | | |
|---|---|---|---|---|
| 2007/0167301 | A1* | 7/2007 | Evans | A63B 21/00047 482/148 |
| 2016/0045787 | A1* | 2/2016 | James | A63B 24/0062 482/8 |
| 2017/0065845 | A1* | 3/2017 | Pinkus | A63B 21/4035 |

OTHER PUBLICATIONS

Stackable Wooden Plyometric Boxes, Retrieved from Internet, Retrieved on Dec. 21, 2021 <URL: https://www.titan.fitness/endurance/plyo-boxes/wooden/stackable-wooden-plyometric-boxes/STKPLYOGROUP.html>.

Bench One & Squat Board Bundle, Retrieved from Internet, Retrieved on Dec. 21, 2021 <URL: https://www.walmart.com/p/Zeno-Gym-Workout-Bench-One-Squat-Board-Press-Glute-Raises-in-Home-Work-Out-Thighs-Quads-Made-High-Density-Foam-Anti-Slip-50-Exercises-Durable-Portabl/806487277>.

Fce Work Device, Retrieved from Internet, Retrieved on Dec. 21, 2021 <URL: https://www.cascadehealthcaresolutions.com/fce-work-device-mobile-weighted-cart/>.

* cited by examiner

FITNESS BLOCK

FIELD OF THE INVENTION

The present invention relates generally to a multifunctional fitness block. More specifically, the present invention is a device that can be utilized in a variety of ways such as step routines, weight training, core strengthening, and targeting specific areas.

BACKGROUND OF THE INVENTION

The fitness industry utilizes a variety of machinery and devices to target various areas on the body to ensure the user can target every area of the body. Most of the gym and fitness equipment is large and takes up lots of spaces to target only one or a few specific areas of the body. This requires the user to purchase various equipment or visit a gym with lots of space to house all the necessary equipment. Additionally, much of this equipment is complicated to properly set up and utilize, resulting in the user wasting time that could be spend working out. Many at home workout devices have come to market promising to target various areas of the body. Unfortunately, many of these devices are built with flimsy materials and designs causing them to damage quickly and easily. Additionally, many of these devices are not properly designed to target multiple areas of the body and usually only target one muscle or a few, requiring the user to obtain multiple devices.

An objective of the present invention is to provide users with a fitness block, to help assist at home workouts and physical therapy exercises. The present invention intends to provide users with a device that allows for an adjustment in weight and various attachment points. In order to accomplish that, a preferred embodiment of the present invention comprises a plurality of handles, plurality of chambers, a plurality of hooks, and a plurality of steps. Further, the plurality of chambers allows the device to alternate between various weights. Thus, the present invention is a multifunctional fitness block that allows the user to target various muscles and perform various exercises without needing multiple fitness machines.

SUMMARY OF THE INVENTION

The present invention is a multipurpose fitness block suitable for a variety of upper body and lower body exercises. The multipurpose fitness block comprises a block body, a plurality of weight inserts, a carrying handle, and a plurality of attachment elements. The block body comprises a plurality of handling channels and a plurality of weight holders. The plurality of weight holders is distributed about the block body. The plurality of handling channels is distributed about the block body. The plurality of weight inserts is connected along the plurality of weight holders. The carrying handle is connected adjacent to the block body. The plurality of attachment elements is distributed about the block body.

DETAIL DESCRIPTIONS OF THE INVENTION

All illustrations of the drawings are for the purpose of describing selected versions of the present invention and are not intended to limit the scope of the present invention. The present invention is to be described in detail and is provided in a manner that establishes a thorough understanding of the present invention. There may be aspects of the present invention that may be practiced or utilized without the implementation of some features as they are described. It should be understood that some details have not been described in detail in order to not unnecessarily obscure focus of the invention. References herein to "the preferred embodiment", "one embodiment", "some embodiments", or "alternative embodiments" should be considered to be illustrating aspects of the present invention that may potentially vary in some instances, and should not be considered to be limiting to the scope of the present invention as a whole.

Figure 1:
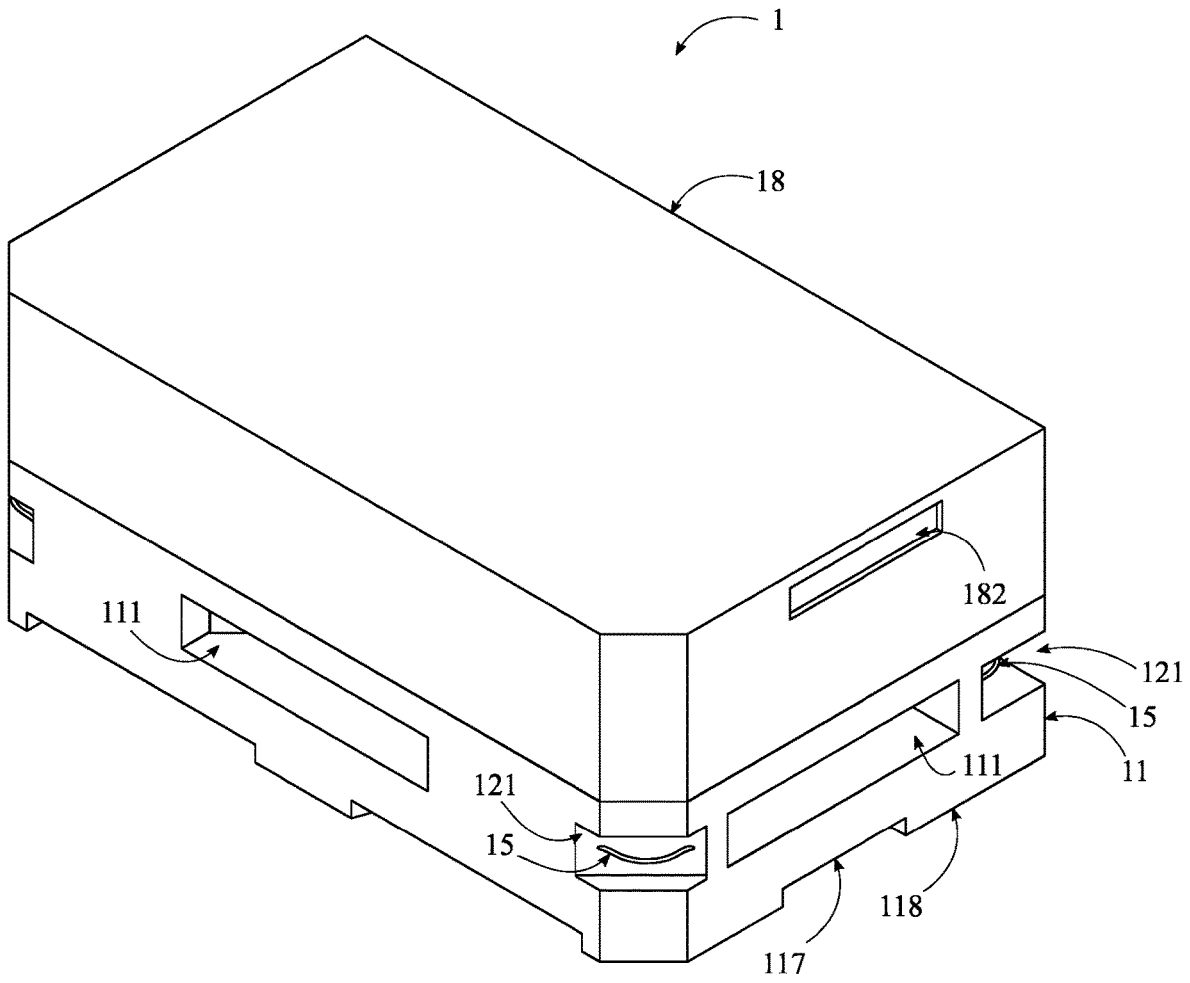
FIG. 1 is a top perspective view of the present invention.
Figure 2:
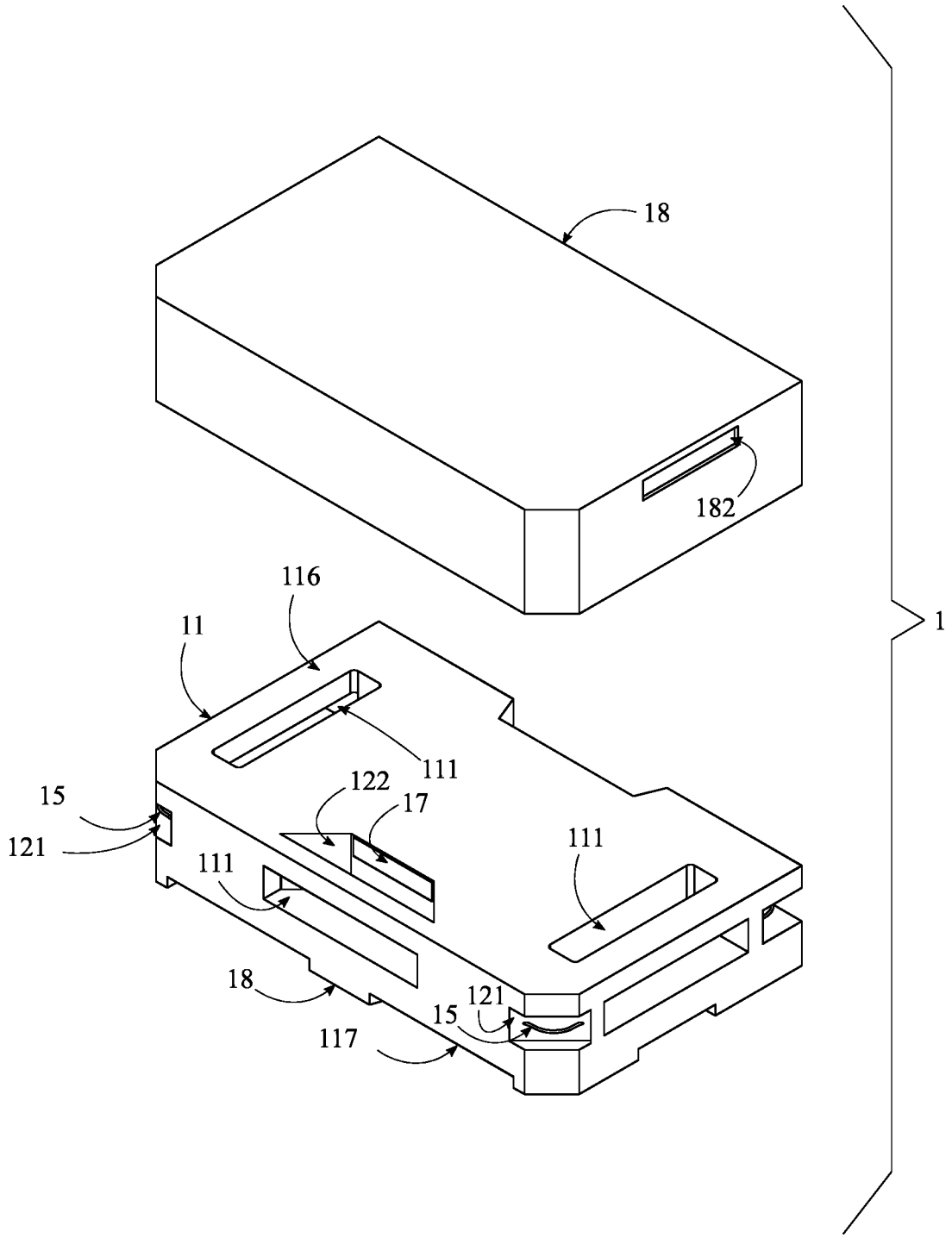
FIG. 2 is a front perspective exploded view of the present invention.
Figure 3:
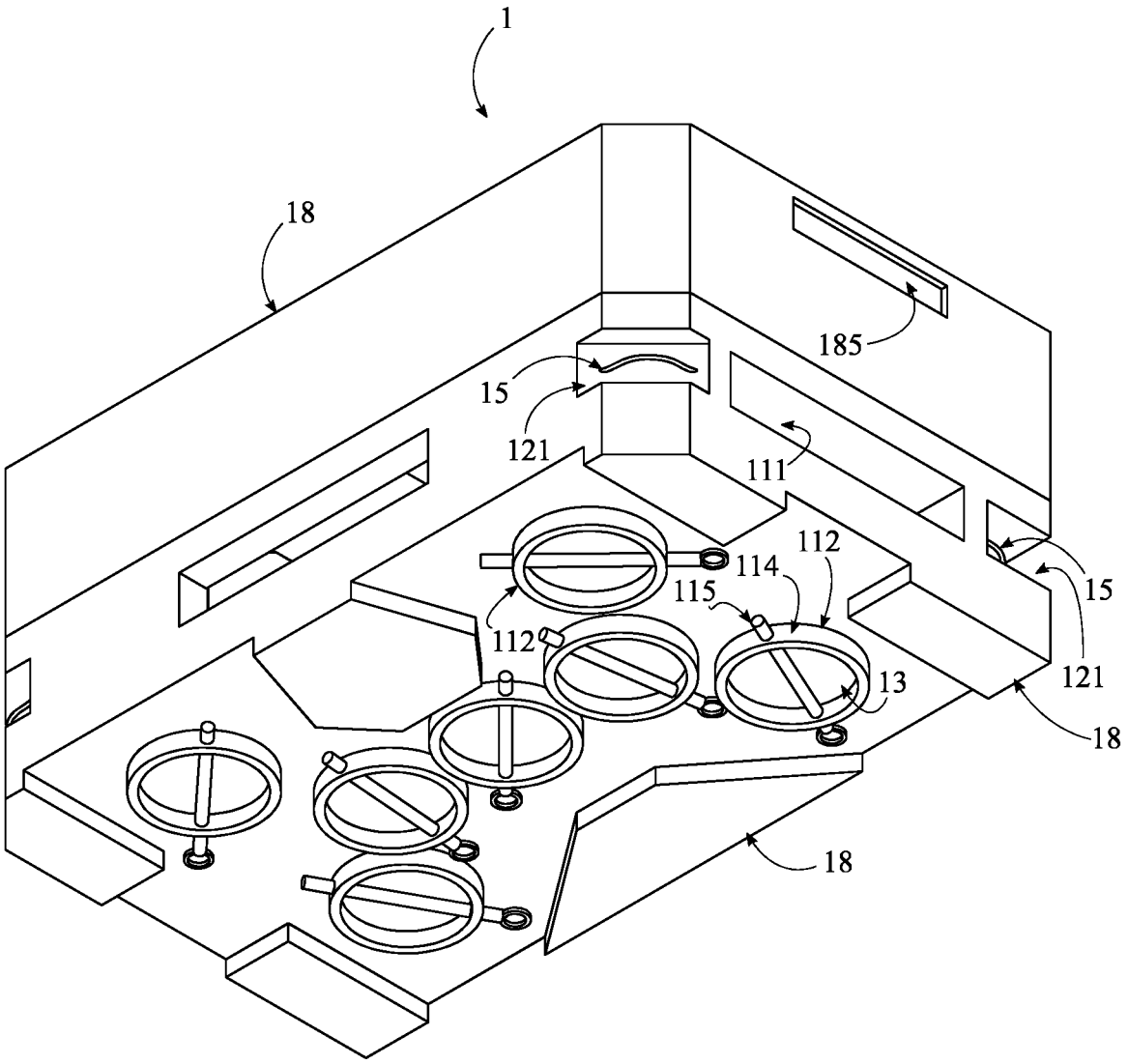
FIG. 3 is a bottom perspective view of the present invention.
Figure 4:
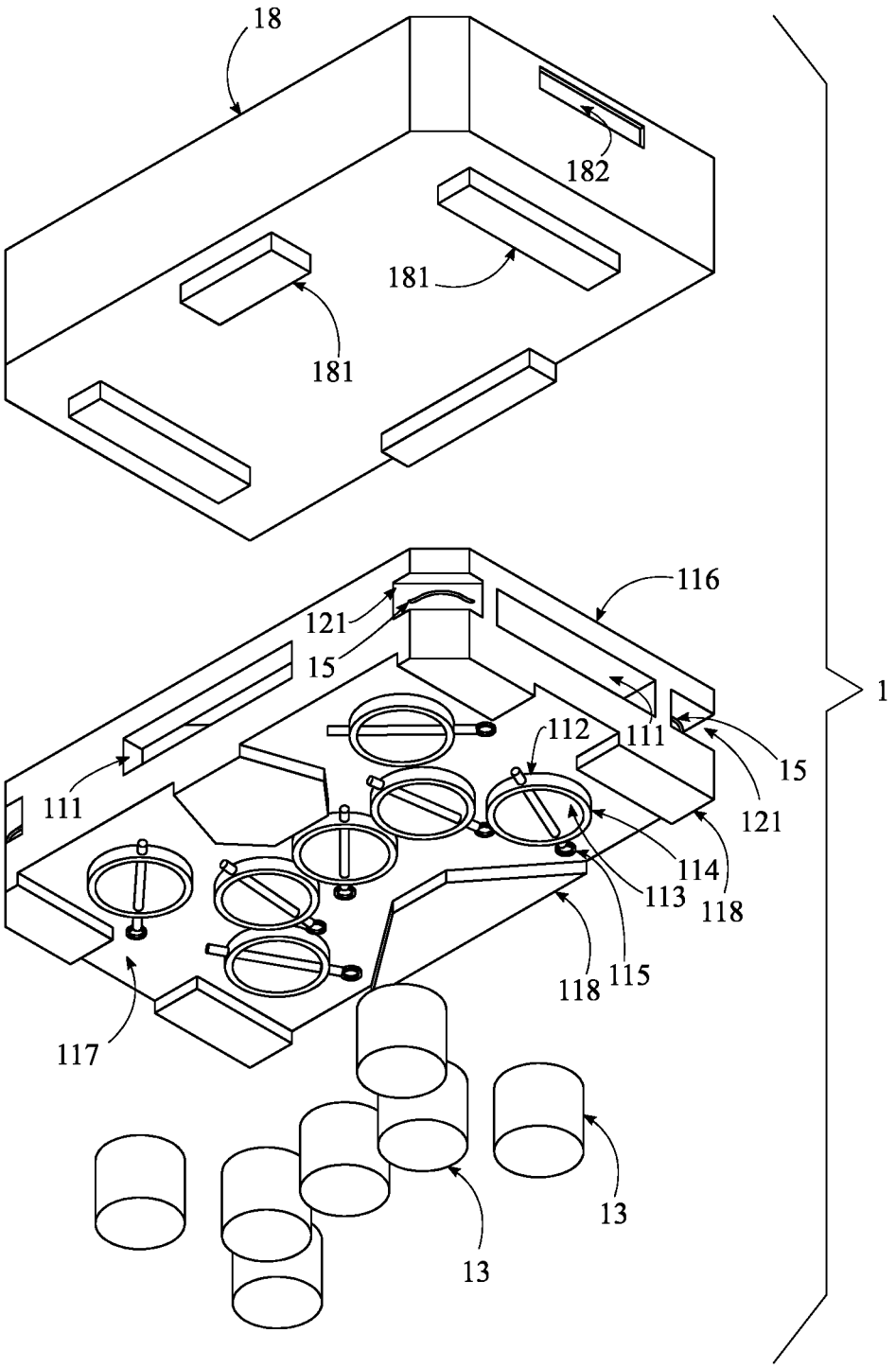
FIG. 4 is a bottom exploded view of the present invention.

In reference to FIGS. 1-7, the present invention is a multipurpose fitness block 1 suitable for a variety of upper body and lower body exercises. In the preferred embodiment, the multipurpose fitness block 1 comprises a block body 11, a plurality of weight inserts 13, a carrying handle 14, and a plurality of attachment elements 15. The block body 11 comprises a plurality of handling channels 111 and a plurality of weight holders 112. In the preferred embodiment, the fitness block is made out of any suitable material, such as, but not limited to polymer, plastic, aluminum, wood, or any other suitable material. In the preferred embodiment, the fitness block is scaled to any suitable size to accommodate any user stature. In the preferred embodiment, the fitness block takes the form of a rectangular shape but may take the form of any other suitable shape. In the preferred embodiment, the block body 11 takes the form of the main chassis of the multipurpose fitness block 1 that secures the components that constitutes the multipurpose fitness block 1. In the preferred embodiment, the block body 11 takes the form of a one-piece mono-body structure made out of a high-density polymer. In various embodiments, the block body 11 is may take the form of any other suitable construction and suitable material. In the preferred embodiment, the plurality of weight inserts 13 takes the form of exercise weights catered to fit and secure within the block body 11 through the plurality of weight holders 112. In the preferred embodiment, the plurality of weight inserts 13 takes the form of cylindrical weight inserts, as shown in FIG. 4. In the preferred embodiment, the plurality of weight inserts 13 is scaled to weigh a specified desired weight suitable for any strength level. In the preferred embodiment, the carrying handle 14 takes the form of any suitable grasping implement that allows the user to grasp and hold the multipurpose fitness block 1 for transportation or exercise applications. In the preferred embodiment, the plurality of attachment elements 15 takes the form of strategically placed attachment implements along the block body 11, where the plurality of attachment elements 15 is configured to receive exercise equipment, including, but not limited to straps, chains, ropes, bungee cords, or any other suitable exercise implement. In one instance, the plurality of attachment elements 15 takes the form of embedded loops that allows the user to attach exercise resistance bands to the block body 11 in order to facilitate various types of exercises that may be performed along the block body 11. In the preferred embodiment, the plurality of handling channels 111 takes the form of strategically placed and distributed cut slots along the block body 11, where the plurality of handling channels 111 is configured to serve as grasping points, allowing the user to grasp and handle the block body 11 in order to perform upper body exercises. In the preferred embodiment, the plurality of weight holders 112 takes the form of weight receiving implements that mounts and secures the plurality of weight inserts 13 within the block body 11.

In reference to FIGS. 3-4, the plurality of weight holders 112 is distributed about the block body 11, where the plurality of weight holders 112 is distributed in any specified pattern suitable for evenly distributing the plurality of weight inserts 13 along the block body 11. The plurality of handling channels 111 is distributed about the block body 11, where the plurality of handling channels 111 is distributed in any specified pattern suitable for upper body exercises. In the preferred embodiment, the plurality of weight inserts 13 is connected along the plurality of weight holders 112 such that the installed plurality of weight inserts 13 is distributed evenly along the block body 11. In the preferred embodiment, the carrying handle 14 is connected adjacent to the block body 11 such that the carrying handle 14 is accessible to the user. In the preferred embodiment, the plurality of attachment elements 15 is distributed about the block body 11, where the plurality of attachment elements 15 is distributed in any specified pattern to accommodate resistance band exercises or any other suitable exercises. In one embodiment, the plurality of attachment elements 15 is distributed on the corners of the block body 11.

In reference to FIGS. 2 and 4-7, the block body 11 comprises an upper surface 116 and a base surface 117. In the preferred embodiment, the upper surface 116 serves as the top surface of the block body 11, where the upper surface 116 is configured to serve as a stepping platform for various exercises. In the preferred embodiment, the base surface 117 serves as the bottom surface of the block body 11, where the block body 11 is laid flat along any suitable flat surface, base side down. The upper surface 116 and the base surface 117 are positioned terminally opposite to each other along the block body 11. In the preferred embodiment, the plurality of handling channels 111 is distributed about the upper surface 116 such that the user is able to access the plurality of handling channels 111 along the upper surface 116. The plurality of weight holders 112 is distributed about the base surface 117, opposite to the plurality of handling channels 111 such that the plurality of weight inserts 13 is installed along the base surface 117 side of the block body 11.

In reference to FIGS. 1-7, the block body 11 further comprises a plurality of legs 118. The plurality of legs 118 takes the form of stabilization members the raises and secures the block body 11 along the flat surface the block body 11 is positioned along. The plurality of legs 118 is distributed about the base surface 117, opposite to the upper surface 116, where the distribution of the plurality of legs 118 is configured to any suitable pattern for even weight distribution and stability.

In reference to FIGS. 3-4, the plurality of weight holders 112 each comprises a holding channel 113, a holding partition 114, and a locking element 115. In the preferred embodiment, the holding channel 113 takes the form of cavities configured for receiving the plurality of weight inserts 13. In the preferred embodiment, the holding partition 114 takes the form of an extruded rim along the holding channel 113, where the holding partition 114 is configured to serve as the mounting platform for the locking element 115. The locking element 115 takes the form of any suitable locking element 115 installed along the holding partition 114 such that the locking element 115 secures the plurality of weight inserts 13 along the holding channel 113. In the preferred embodiment, the locking element 115 takes the form of a locking pin but may take the form of any other suitable locking element 115. The holding channel 113 traverses from the base surface 117 to the upper surface 116, where the holding channel 113 is configured to receive and position the plurality of weight inserts 13 within the block body 11. The holding partition 114 is concentrically aligned with the holding channel 113, where the holding partition 114 is configured to receive the locking element 115, such that the locking element 115 prevents the installed plurality of weight inserts 13 from sliding out of the block body 11. The holding partition 114 is connected adjacent to the base surface 117. The locking element 115 is selectively engaged to the holding partition 114, where the locking element 115 is configured to allow a user to selectively remove or install the locking element 115 in order to install or remove the plurality of weight inserts 13 along the holding channel 113 of the plurality of weight holders 112. The plurality of weight inserts 13 is removably attached to the plurality of weight holders 112 through the locking element 115.

Figure 5:
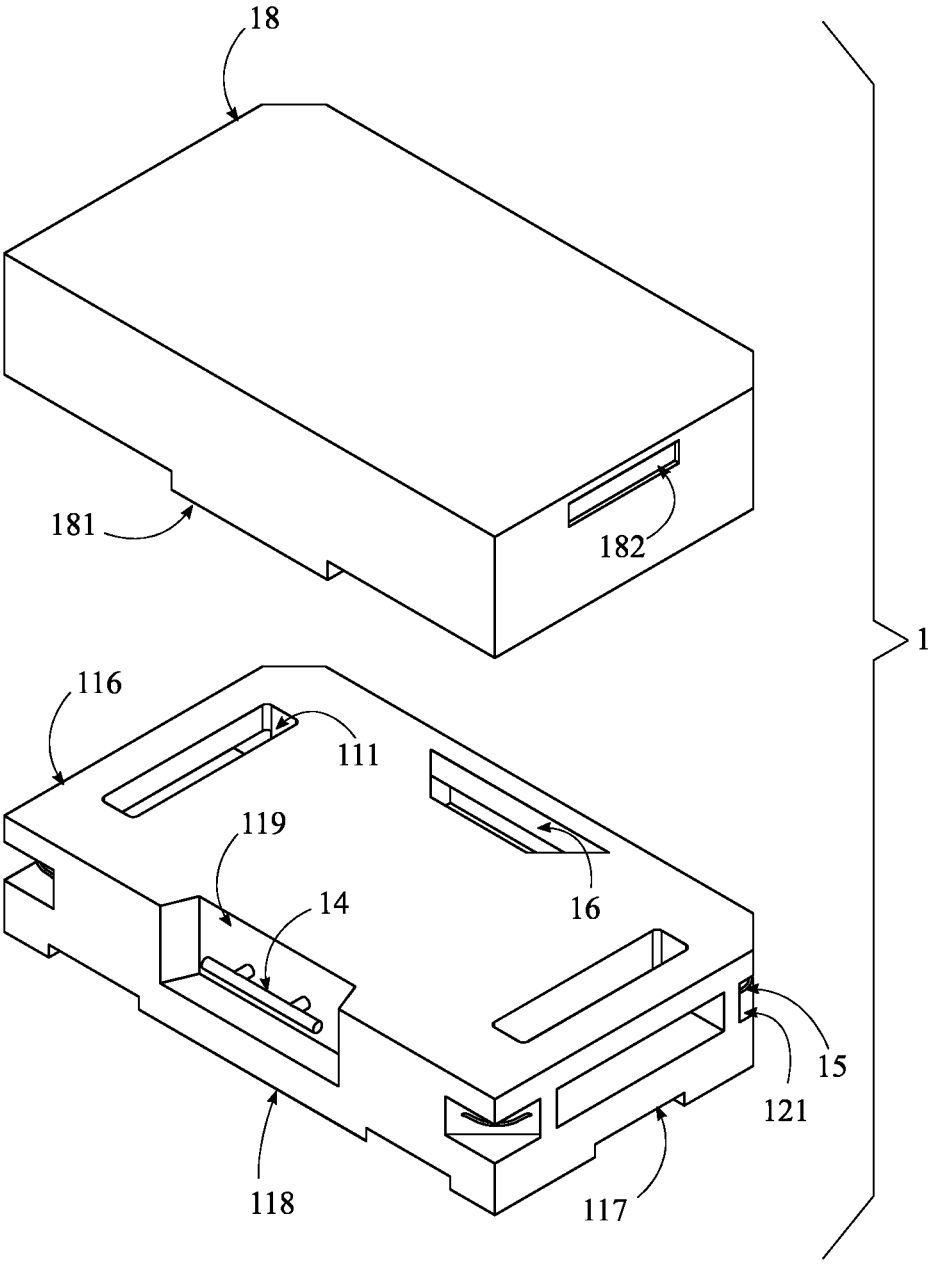
FIG. 5 is a rear perspective view of the present invention.
Figure 6:
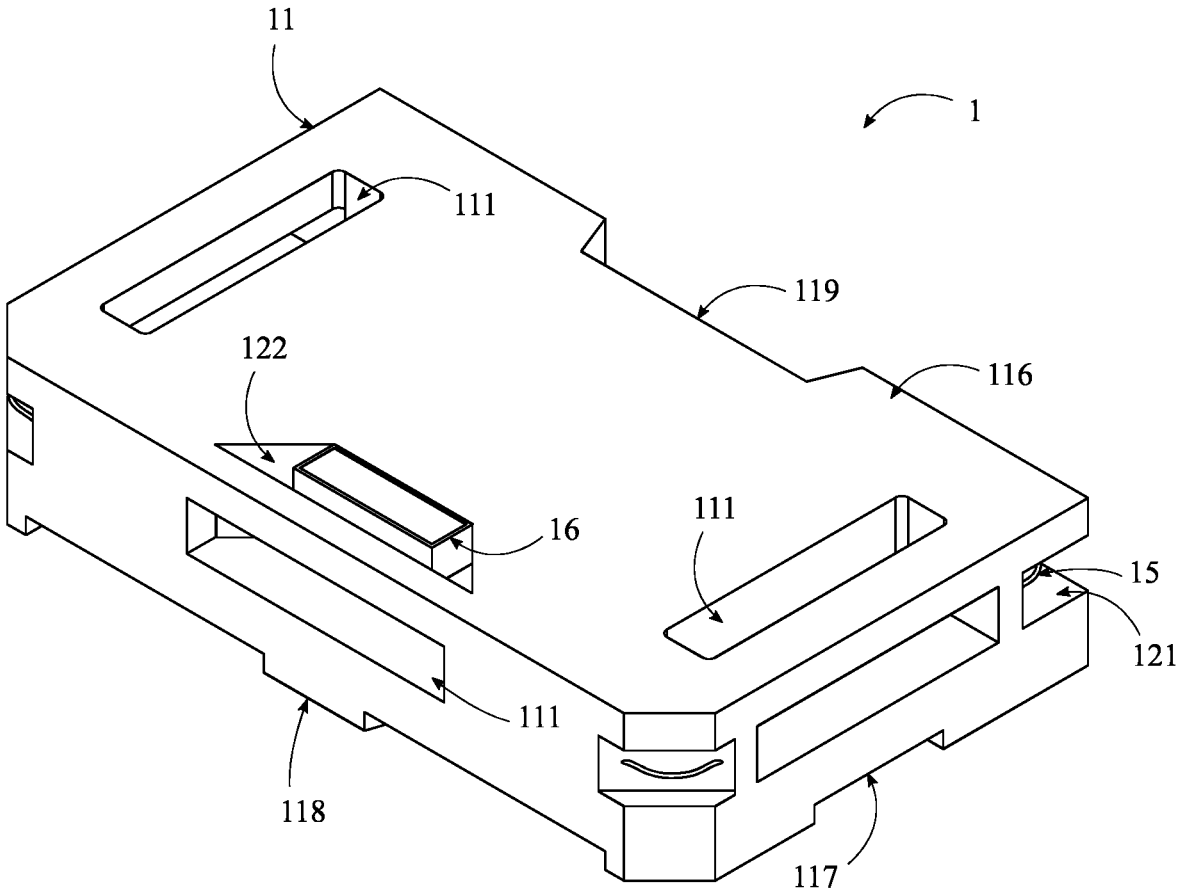
FIG. 6 is front perspective view of the present invention that shows a block body.
Figure 7:
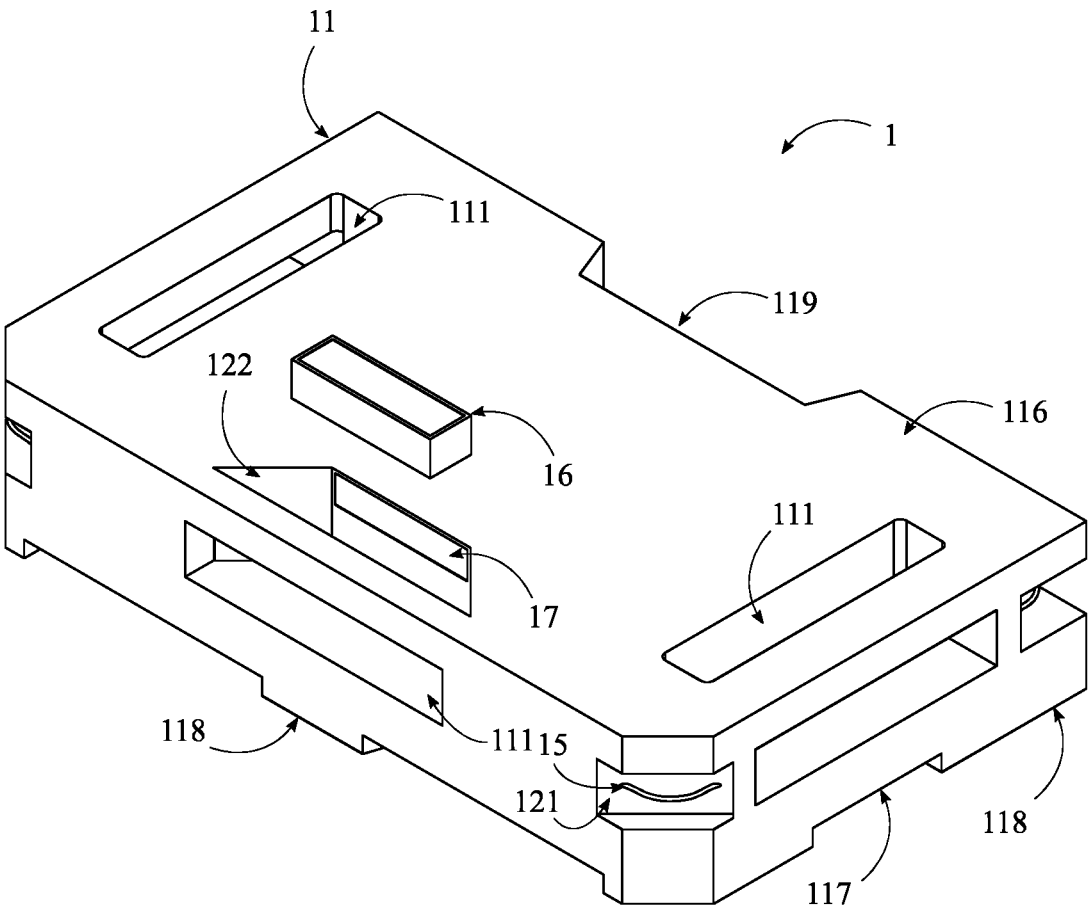
FIG. 7 is a rear perspective view of the present invention that shows the block body.

In the preferred embodiment, the block body 11 further comprises a handle channel 119, as shown in FIGS. 5-7. The handle channel 119 traverses into the block body 11. In the preferred embodiment, the handle channel 119 takes the form of a clearance channel that positions the carrying handle 14 within the block body 11 such that the carrying handle 14 is not protruding, facilitating easier storage and handling of the block body 11 and protecting the carrying handle 14 from damage. The carrying handle 14 is connected within the handle channel 119.

In the preferred embodiment, the block body 11 further comprises a plurality of attachment channels 121, shown in FIGS. 1-7. The plurality of attachment channels 121 serves as clearance channel implements that positions the plurality of attachment elements 15 within the block body 11 such that the plurality of attachment channels 121 is not protruding along the block body 11, facilitating easier storage and handling of the block body 11 and protecting the plurality of attachment elements 15 from damage. The plurality of attachment channels 121 is distributed about the block body 11. The plurality of attachment elements 15 is connected within the plurality of attachment channels 121.

In the preferred embodiment, the multipurpose fitness block 1 further comprises a clock insert 16 and a fastening element 17. In the preferred embodiment, the clock insert 16 takes the form of an external fitness clock suitable for pacing exercises in a timely manner. In the preferred embodiment, the fastening element 17 takes the form of any suitable fastening element 17 suitable for mounting the clock insert 16 along the block body 11. In the preferred embodiment, the fastening element 17 takes the form of magnet style fasteners but may take the form of any other suitable fastening element 17. In the preferred embodiment, the block body 11 further comprises a clock channel 122. In the preferred embodiment, the clock channel 122 takes the form of a storage channel that facilitates the mounting of the clock insert 16 within the block body 11 such that the clock insert 16 is mounted flush along the block body 11. The clock channel 122 traverses into the block body 11. The clock insert 16 is connected within the clock channel 122 through the fastening element 17.

The multipurpose fitness block 1 further comprises a step extension 18, as shown in FIGS. 1-5. The step extension 18 comprises a plurality of connection elements 181. In the preferred embodiment, the step extension 18 takes the form of a height extension accessory configured to extend the multipurpose fitness block 1 in height. In the preferred embodiment, the plurality of connection elements 181 takes the form of any suitable connection element that secures the step extension 18 to the block body 11. The plurality of connection elements 181 is distributed about the step extension 18. The plurality of connection elements 181 is enmeshed to the plurality of handling channels 111, where the plurality of connection elements 181 is configured to secure along the plurality of handling channels 111 such that the step extension 18 is secured along the block body 11 such that the step extension 18 does not shear from the block body 11, as shown in FIGS. 1-5. The step extension 18 is connected adjacent to the block body 11, where the step extension 18 is configured to increase the block body 11 in length. In the preferred embodiment, the step extension 18 further comprises a plurality of extension handles 182. In the preferred embodiment, the plurality of extension handles 182 takes the form of any suitable grasping implement that allows the user to grasp and handle the step extension 18 with ease. The plurality of extension handles 182 is distributed about the step extension 18.

Although the invention has been explained in relation to its preferred embodiment, it is to be understood that many other possible modifications and variations can be made without departing from the spirit and scope of the invention as hereinafter claimed.

What is claimed is:

1. A multipurpose fitness block comprising:
a block body;
a plurality of weight inserts;
a carrying handle;
a plurality of attachment elements;
the block body comprising a plurality of handling channels, a plurality of weight holders, an upper surface, and a base surface;
the plurality of weight holders being distributed about the block body;
the plurality of handling channels being distributed about the block body;
the plurality of weight inserts being connected along the plurality of weight holders;
the carrying handle being connected adjacent to the block body;
the plurality of attachment elements being distributed about the block body;
the upper surface and the base surface being positioned terminally opposite to each other along the block body;
the plurality of handling channels being distributed about the upper surface;
the plurality of weight holders being distributed about the base surface, opposite to the plurality of handling channels;
the plurality of weight holders each comprising a holding channel, a holding partition, and a locking element;
the holding channel traversing from the base surface to the upper surface;
the holding partition being concentrically aligned with the holding channel;
the holding partition being connected adjacent to the base surface;
the locking element being selectively engaged to the holding partition;
the plurality of weight inserts being removably attached to the plurality of weight holders through the locking element.

2. The multipurpose fitness block as claimed in claim 1 comprising:
the block body further comprising a plurality of legs; and
the plurality of legs being distributed about the base surface, opposite to the upper surface.

3. The multipurpose fitness block as claimed in claim 1 comprising:
the block body further comprising a handle channel;
the handle channel traversing into the block body; and
the carrying handle being connected within the handle channel.

4. The multipurpose fitness block as claimed in claim 1 comprising:
the block body further comprising a plurality of attachment channels;
the plurality of attachment channels being distributed about the block body; and
the plurality of attachment elements being connected within the plurality of attachment channels.

5. The multipurpose fitness block as claimed in claim 1 comprising:
a clock insert;
a fastening element;
the block body further comprising a clock channel;
the clock channel traversing into the block body; and
the clock insert being connected within the clock channel through the fastening element.

6. A multipurpose fitness block comprising:
a block body;
a plurality of weight inserts;
a carrying handle;
a plurality of attachment elements;
a clock insert;
a fastening element;
the block body comprising a plurality of handling channels, a plurality of weight holders, an upper surface, and a base surface;
the upper surface and the base surface being positioned terminally opposite to each other along the block body;
the plurality of weight holders being distributed about the block body;
the plurality of weight holders being distributed about the base surface, opposite to the plurality of handling channels;
the plurality of handling channels being distributed about the block body;
the plurality of handling channels being distributed about the upper surface;
the plurality of weight inserts being connected along the plurality of weight holders;
the carrying handle being connected adjacent to the block body;
the plurality of attachment elements being distributed about the block body;
the block body further comprising a clock channel;
the clock channel traversing into the block body; and
the clock insert being connected within the clock channel through the fastening element.

7. The multipurpose fitness block as claimed in claim 6 comprising:
the block body further comprising a plurality of legs; and
the plurality of legs being distributed about the base surface, opposite to the upper surface.

8. The multipurpose fitness block as claimed in claim 6 comprising:

the block body further comprising a plurality of attachment channels;

the plurality of attachment channels being distributed about the block body; and the plurality of attachment elements being connected within the plurality of attachment channels.

9. The multipurpose fitness block as claimed in claim 6 comprising:

the block body further comprising a handle channel;

the handle channel traversing into the block body; and the carrying handle being connected within the handle channel.

10. A multipurpose fitness block comprising:

a block body;

a plurality of weight inserts;

a carrying handle;

a plurality of attachment elements;

a step extension;

the block body comprising a plurality of handling channels and a plurality of weight holders;

the step extension comprising a plurality of connection elements;

the plurality of weight holders being distributed about the block body;

the plurality of handling channels being distributed about the block body;

the plurality of weight inserts being connected along the plurality of weight holders;

the carrying handle being connected adjacent to the block body;

the plurality of attachment elements being distributed about the block body;

the plurality of connection elements being distributed about the step extension;

the plurality of connection elements being enmeshed to the plurality of handling channels; and the step extension being connected adjacent to the block body, wherein the step extension is configured to increase the block body in length.

11. The multipurpose fitness block as claimed in claim 10 comprising:

the step extension further comprising a plurality of extension handles; and the plurality of extension handles being distributed about the step extension.

12. The multipurpose fitness block as claimed in claim 10 comprising:

the block body further comprising a plurality of attachment channels;

the plurality of attachment channels being distributed about the block body; and the plurality of attachment elements being connected within the plurality of attachment channels.

13. The multipurpose fitness block as claimed in claim 10 comprising:

a clock insert;

a fastening element;

the block body further comprising a clock channel;

the clock channel traversing into the block body; and the clock insert being connected within the clock channel through the fastening element.

14. The multipurpose fitness block as claimed in claim 10 comprising:

the block body further comprising a handle channel;

the handle channel traversing into the block body; and the carrying handle being connected within the handle channel.

* * * * *